United States Patent [19]

Barrus et al.

[11] 4,044,668

[45] Aug. 30, 1977

[54] PRINT HAMMER MECHANISM

[75] Inventors: Gordon Brent Barrus; Leo Joseph Emenaker, both of El Segundo, Calif.

[73] Assignee: Printronix, Inc., Irvine, Calif.

[21] Appl. No.: 728,746

[22] Filed: Oct. 1, 1976

Related U.S. Application Data

[63] Continuation of Ser. No. 578,180, May 16, 1975, abandoned.

[51] Int. Cl.[2] ..... B41J 7/70

[52] U.S. Cl. ..... 101/93.04; 101/93.48; 197/1 R

[58] Field of Search ..... 197/1 R; 101/93.29–93.35, 93.48, 93.04, 93.05; 312/236; 85/61; 174/16 R, 15 R; 335/300

[56] References Cited

U.S. PATENT DOCUMENTS

| | | | |
|---|---|---|---|
| 3,258,887 | 7/1966 | Masteller | 85/61 X |
| 3,291,276 | 12/1960 | Milne et al. | 197/1 R |
| 3,354,818 | 11/1967 | Haas | 101/93.29 X |
| 3,364,838 | 1/1968 | Bradley | 174/16 R X |
| 3,659,238 | 4/1972 | Griffing | 101/93.48 X |
| 3,673,955 | 7/1972 | Curtiss et al. | 101/93.18 |
| 3,782,278 | 1/1974 | Barnett et al. | 101/93.04 |
| 3,802,544 | 4/1974 | Howard et al. | 197/1 R |
| 3,804,008 | 4/1974 | Hoyer | 101/93.04 |
| 3,878,778 | 4/1975 | Gomi | 101/93.29 |

*Primary Examiner*—Edward M. Coven
*Attorney, Agent, or Firm*—Fraser and Bogucki

[57] ABSTRACT

A hammer mechanism which undergoes reciprocating motion across platen-supported paper webs in a dot matrix printer effects printing by momentarily energizing coils associated with selected resilient hammer elements mounted on a common magnetic structure to neutralize a magnetic field from the common magnetic structure and release the hammer elements from a retracted position. Each end of the common magnetic structure extends to define dummy hammer positions adjacent the first hammer element on each end, providing uniform magnetic field strength to the end hammer elements and to all hammer elements in between. The hammer elements are fabricated and mounted as individual elements of resilient magnetic material with mounting of the elements being accomplished in pairs using a common plate for each pair and screws which have a portion of reduced diameter directly behind the head thereof to provide easy access to the shaft of the screw in the event of breakage during installation. The hammer mechanism is surrounded by a housing having a front face adjacent the hammer elements which is of magnetic material to increase the flux density for hammer elements of given size and which has an opening therein equipped with a filter to permit the exit of cooling air introduced under pressure into the housing while preventing contaminants from getting inside the housing.

18 Claims, 8 Drawing Figures

FIG. 2
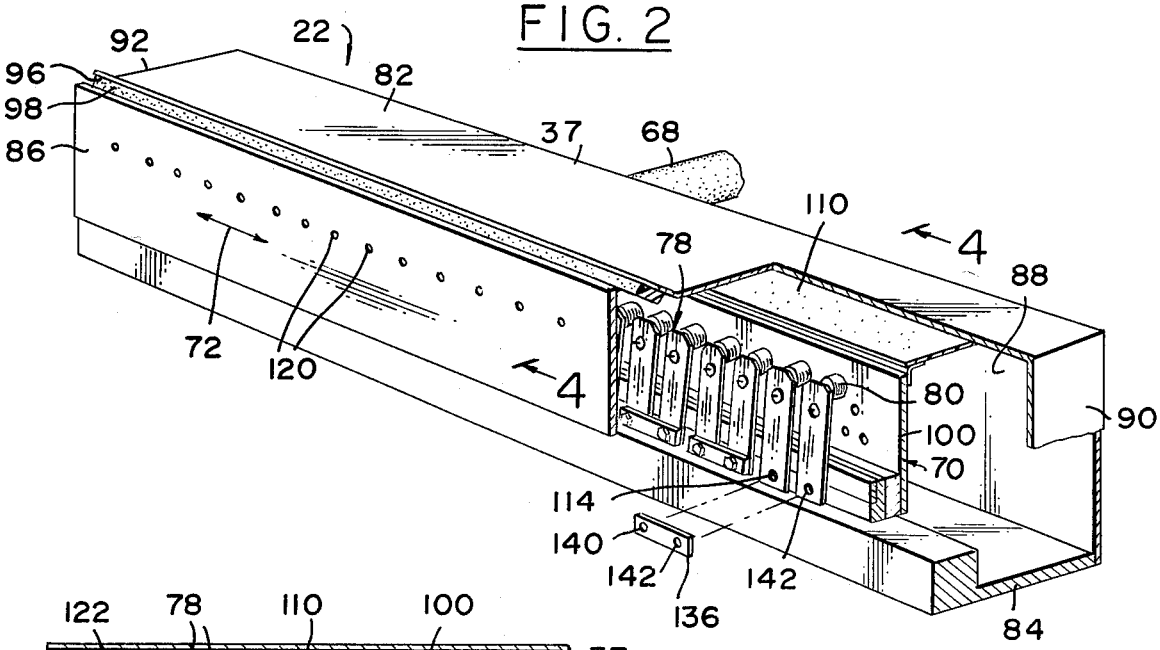
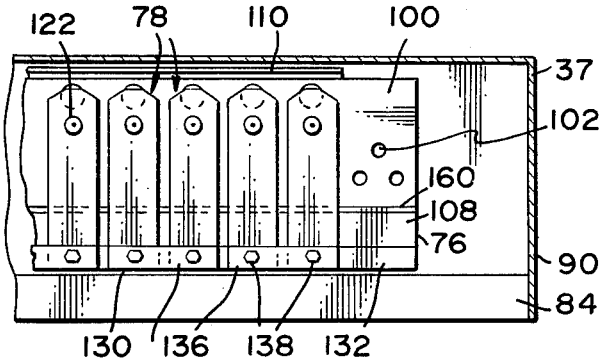
FIG. 3
FIG. 4
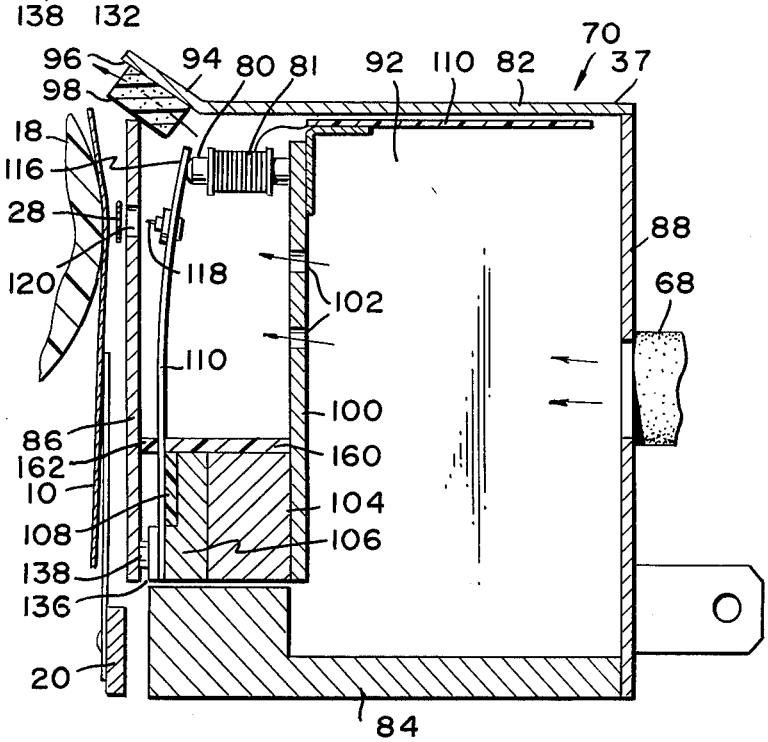

PRINT HAMMER MECHANISM

This is a continuation of application Ser. No. 578,180, filed May 16, 1975 and now abandoned.

BACKGROUND OF THE INVENTION

1. Field of the Invention

This invention relates to mechanical printers, and more specifically to character printing mechanisms of the dot matrix type.

2. History of the Prior Art

Mechanical printing systems, particularly those known as line printers, have been widely used in the data processing industry. Many such systems are of the moving character type employing formed character images on a member which is moved relative to the paper so as to present a desired type position for an impacting action between the character image and paper. Other systems have been of the wire matrix type in which a printer head is used that has a number of separately actuable print wires, one for each possible vertical position within a matrix.

Dot matrix printers employing a movable hammer bank, as evidenced for example by U.S. Pat. No. 3,782,278, have proven to have a number of advantages over other systems. Particularly advantageous is a system of this type disclosed in a co-pending application, Ser. No. 495,830, Barrus et al., Printer System, filed Aug. 8, 1974 and assigned to the assignee of the present application. In the printer system disclosed in Ser. No. 495,830 each of a plurality of hammers scans a number of dot printing positions within a dot matrix line and is energized at a high repetition rate during movement to imprint serially the dot patterns in that line for several successive characters. The paper is then advanced and the next dot matrix line is printed in the reverse direction. The hammers are mounted within a shuttle mechanism which is driven in a trapezoidal velocity profile from a cam system that also engages an oppositely moving counterweight system. The hammer bank is comprised of plural hammer elements and associated magnetic actuators. The hammer elements which are normally magnetically biased to a retract position by a permanent magnet are selectively released for imprinting by the magnetic actuators which neutralize the magnetic field from the permanent magnet.

The present invention provides certain alternatives and improvements to a hammer bank or mechanism of the type shown in application Ser. No. 495,830.

BRIEF SUMMARY OF THE INVENTION

Printer hammer mechanisms in accordance with the invention include an elongated magnetic circuit structure having a permanent magnet extending along the length thereof adjacent one edge of the structure and a plurality of individual coils spaced apart along the length of the structure adjacent an opposite edge thereof. Hammer elements of resilient magnetic material have one end thereof coupled to the permanent magnet and an opposite end disposed adjacent one of the coils. Energization of one of the coils causes momentary release of the associated hammer element from its retracted position against a pole piece surrounded by the coil, the hammer element springing out of its retracted position at a known velocity and with a known force to move a printing tip mounted on the hammer element through a hole in a housing surrounding the hammer mechanism and against platen supported paper webs. When energization of the coil is terminated, the magnetic field from the permanent magnet returns the hammer element to its retracted position.

In accordance with one aspect of the invention the magnetic circuit structure and included permanent magnet are extended at the opposite ends thereof to define dummy hammer positions adjacent the first hammer position at each of the opposite ends of the mechanism. The magnetic circuit structure within the dummy hammer positions provides a field strength in each of the end hammer positions of the bank substantially equal to that at all other hammer positions within the bank, providing a uniform field strength throughout the functional hammer positions.

In accordance with another aspect of the invention the hammers are comprised of resilient magnetic elements which are individually fabricated and individually mounted to the magnetic circuit structure. This allows for relatively precise fabrication and testing of the individual hammers as well as their interchangeability within a given hammer mechanism and precise mounting and alignment within the mechanism.

In accordance with a further aspect of the invention the hammer elements may be mounted on the magnetic circuit structure in pairs using a different mounting plate for each pair of hammer elements and a pair of screws which break immediately behind the heads thereof when torqued excessively. The simultaneous installation of the pair of screws through the common mounting plate and the pair of hammer elements and into the magnetic circuit structure prevents the mounting plate and thereby the hammer elements from twisting as the screws are tightened. The screws can be substantially tightened without fear of breakage since each screw is provided with a portion of reduced diameter immediately behind the head. This insures that a substantial portion of the screw shaft will extend from the magnetic circuit structure to permit easy removal in the event the screw is broken due to excessive torquing. The screws pass through relatively large holes in the lower ends of the hammer elements permitting considerable tolerance in the alignment and adjusting of the hammer elements during installation.

In accordance with a further aspect of the invention the front face of the housing surrounding the hammer mechanism is made of magnetic material, forming an additional flux path in parallel to the path defined by each hammer element. This additional flux path provides for increased flux density for hammer elements of given size, providing a greater retracting force for the hammer elements where necessary or desirable.

In accordance with a still further aspect of the invention the interior of the housing is provided with pressured and filtered air to effect cooling of the hammer mechanism and particularly the coils. A source of pressurized and filtered air is coupled to the interior of the housing via a flexible hose communicating through a sidewall of the housing. The opposite end of the magnetic circuit structure may be spaced apart from the end walls of the housing, permitting the air introduced into the housing on one side of the magnetic circuit structure to flow to the other side of the structure and then around the coils. In addition to or in lieu thereof the magnetic circuit structure may be provided with apertures to pass the introduced air to the coils. The introduction of air into the interior of the housing has the further effects of tending to prevent contaminants from entering the housing and of deadening sound made by the hammers.

In accordance with a still further aspect of the invention filters are used to protect the hammer mechanism from contaminants such as dust while at the same time providing an exit for the air introduced into the housing. Once such filter is placed within an opening near the top of the housing to permit the free exit of the pressurized air while at the same time absorbing much of the sound generated by the hammer mechanism inside the housing and preventing dust and other contaminants outside the housing from entering and contaminating the hammer mechanism. Other filter elements are disposed between the hammer elements and the magnetic circuit structure and the front face of the housing to prevent dust and other contaminants from lodging between the hammer elements and the surrounding structure and thereby inhibiting the free operation thereof.

BRIEF DESCRIPTION OF THE DRAWINGS

A better understanding of the invention may be had by reference to the following description, taken in conjunction with the accompanying drawings, in which:

FIG. 2 is a perspective view, partly broken away and partly exploded, of a hammer mechanism in accordance with the invention;

FIG. 3 is a front elevational view with a portion of the housing removed of a portion of the hammer mechanism of FIG. 2;

FIG. 4 is a sectional view taken along the lines 4—4 of FIG. 2;

DETAILED DESCRIPTION

Figure 1:
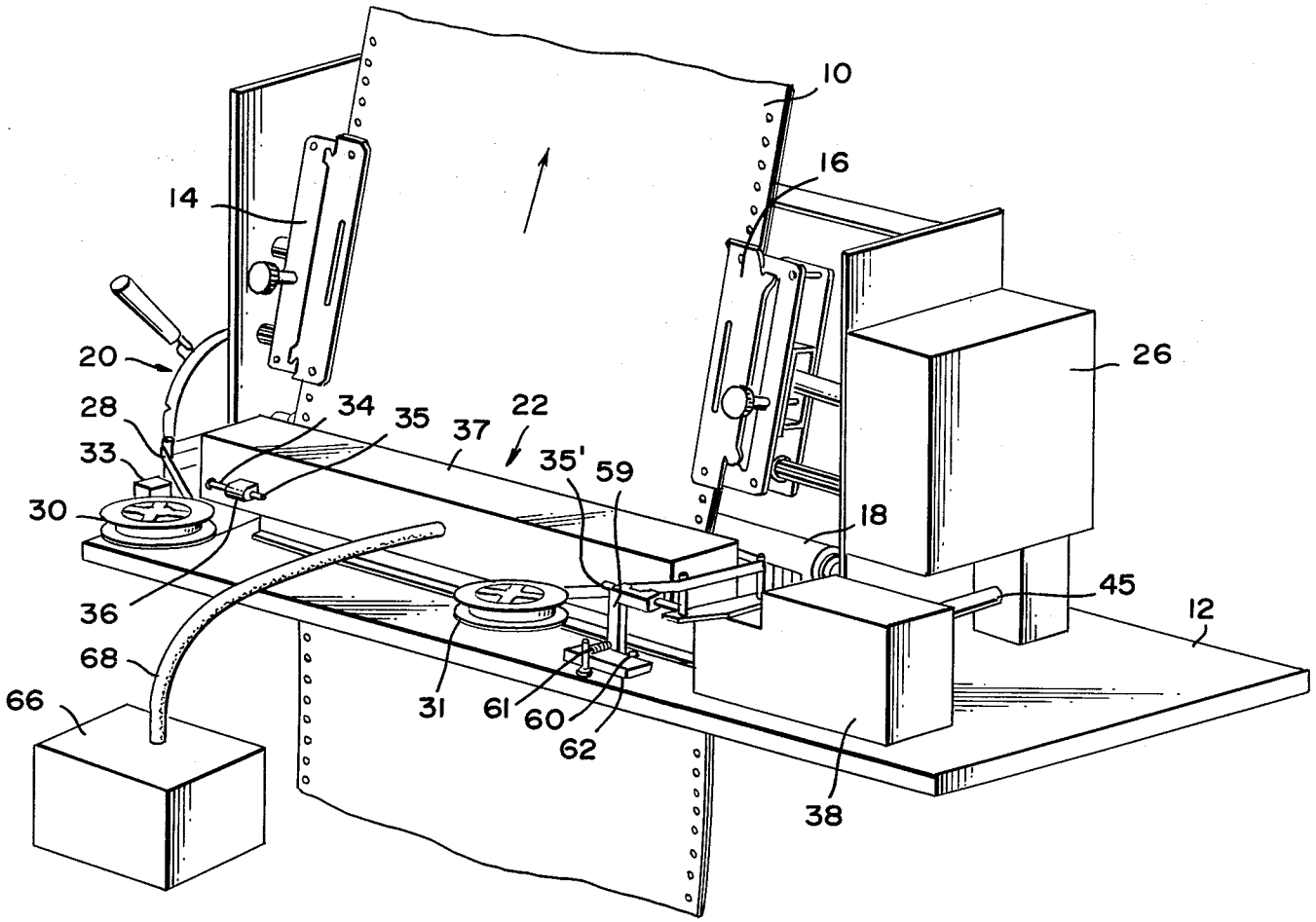
FIG. 1 is a perspective view, partially broken away, of the principal mechanical elements of a printer system of the type employing hammer mechanisms in accordance with the invention.

An example of a printer in accordance with the invention comprises a 132 column page printer for data processing systems, operating typically at about 300 lines per minute and printing an original and a substantial number (e.g. five) of clear carbon copies. The principal mechanical elements of the printer are shown in FIG. 1. Such elements are hereafter described without reference to detail inasmuch as they are shown and described in detail in the previously referred to co-pending application Ser. No. 495,830.

Referring to FIG. 1 the paper to be imprinted comprises one or a number of webs 10 of conventional edge perforated, continuous or fan folded sheet fed upwardly through a base frame 12 and past a horizontal printing line position at which printing takes place. The original and carbon sheets are advanced together past the printing line by known tractor drives 14, 16, engaging the edge sprocket perforations along the two margins of the paper. Just below the printing line, the webs 10 are held flat, under controlled tension and in registration, without entrapped air pockets against a platen 18, by a paper thickness adjustment control 20.

At the printing line, a shuttle mechanism 22 includes a hammer mechanism as shown in detail in FIG. 2 and thereafter which is horizontally reciprocated to span a desired number of character column positions. This example assumes that there are to be 132 character positions or columns across the paper 10, and a bank of 44 hammers is employed, with the lateral travel thus being sufficiently wide (0.3 inches in this example) for each hammer to move across three different adjacent columns. Both 5×7 and 9×7 dot matrixes are now widely used to define characters in dot printing systems; the description of the present system is based upon a 9×7 dot matrix but may use virtually any matrix, and may in fact interchange between different matrixes. The hammers are operated concurrently during the reciprocating motion to write selectively spaced dots within a horizontal dot matrix line in each of the three associated columns for each hammer. The paper 10 is then advanced by a stepping motor mechanism 26 to the next horizontal matrix line position. Thus the system concurrently writes different character segments in serial dot row fashion, first in one direction and then in the other.

At the printing line position, a ribbon 28 is interposed between the shuttle 22 and the paper 10, the ribbon 28 being advanced by any suitable means, such as the supply and take-up reels 30, 31 shown, or a ribbon carriage supply and drive.

Vertical shuttle support elements 33 mounted on the base frame 12 include linear bearings 34 for receiving horizontal support shafts 35, 35'. The shafts 35, 35' are coupled by brackets 36 to a horizontal channel member defining a housing 37 for the shuttle 22. As described hereafter the housing 37 surrounds the hammer mechanism and includes a magnetic front face which reciprocates together with the hammer mechanism. The remainder of the housing 37 which does not reciprocate mounts the hammer mechanism and the included front face for reciprocating motion.

The hammer assembly within the shuttle mechanism 22 is reciprocated by a cam assembly 38 described in detail in co-pending application Ser. No. 495,830. A rotatable cam follower engages the periphery of a double lobed cam which is rotated by a shaft 45 coupled to a flywheel and drive system (not shown). On the opposite side of the cam from the first cam follower, and in axial alignment therewith, a second rotatable cam follower also engages the cam periphery. The second cam follower is mounted within a counterweight structure rotatable about an axis substantially parallel to the axis of the shaft 45. The second cam follower is spring biased into constant engagement with the cam.

For ease of feeding the webs 10 past the printing line position, the shuttle mechanism 22 is pivotably rotatable about the off-axis support shafts 35, 35' at the brackets 36. However, the shuttle mechanism is normally held at its printing position under the force exerted by a tension spring 61 coupling a dependent bracket 59 on the shaft to the frame 12. A limit stop position for the bracket 59 is defined by engagement of a friction bearing element 60 against a linear surface defined by a reference member 62 mounted on the frame 12. The entire shuttle mechanism 22 can therefore pivot about the axis of the shafts 35, 35' away from the printing line position so as to provide greater clearance between the hammer tips and the facing paper control mechanism 20 to gain access to the hammer mechanism for cleaning.

An air source 66 filters air and forces it under pressure through a flexible hose 68 to the shuttle mechanism 22. As described hereafter the air is used to cool the hammer mechanism.

As previously noted the shuttle mechanism 22 includes a hammer mechanism slidably mounted for reciprocating motion within the housing 37. A hammer mechanism 70 in accordance with the invention is shown in FIG. 2. The hammer mechanism 70 which undergoes motion in the directions shown by an arrow 72 is surrounded by the housing 37 having a hollow interior in which are mounted a magnetic circuit structure 76, a plurality of hammers 78 and a plurality of pole pieces 80, each surrounded by an electrical coil 81. The housing 37 is comprised of a top 82, a bottom 84, opposite sides 86 and 88, and opposite ends 90 and 92. An edge portion 94 of the top 82 is bent upwardly at an angle from the rest of the top 82 to define an opening 96 with the side 86 along the length of the cover 74. The flexible hose 68 is coupled to the side 88 where it introduces air under pressure into the interior of the cover 74. The flexible hose 68 is coupled to the side 88 where it introduces air under pressure into the interior of the cover 74. Most of the air introduced into the cover 74 eventually exits through a filter 98 disposed within the opening 96.

The side 86 of the housing 37 is attached to and reciprocates with the hammer mechanism 70. The hammer mechanism 70 is mounted for sliding motion on the bottom 84 which together with the side 88, the top 82 and the ends 86 and 88 forms the non-reciprocating part of the housing 37.

The magnetic circuit structure 76 includes a planar common return member 100 of magnetic material extending generally vertically from adjacent the bottom 84 to the vicinity of the top 82. The member 100 which is spaced apart from the opposite ends 90 and 92 to permit circulation of air from one side of the member 100 to the hammers 78 and coils 81 at the other side of the member 100 is also provided with a plurality of apertures 102 to facilitate passage of the air directly through the member 100. In addition to the common return member 100 the magnetic circuit structure 76 also includes an elongated permanent magnet 104 and an elongated insert 106 of magnetic material. The permanent magnet 104 is mounted at one edge of and extends along the length of the common return member 100 with the pole pieces 80 being mounted in spaced apart relation along the common return member 75 adjacent an opposite edge of the member 100. The insert 106 is generally co-extensive with and is mounted on a side of the permanent magnet 104 opposite the common return member 100. The hammers 78 which are comprised of magnetic material are mounted on the insert 106. A resilient damping element 108 of butyl rubber or similar material is disposed between a portion of the insert 106 and the hammers 78. The coils 81 surrounding the pole pieces 80 are electrically coupled to a printed circuit board 110 mounted on the common return member 100.

The hammers 78 are comprised of elongated, resilient magnetic spring elements 110 mounted at a lower end 112 via a hole 114 to the magnetic circuit structure 76. An opposite movable upper end 116 is disposed adjacent a particular one of the pole pieces 80. The hammer elements 110 are of magnetic material of 0.030 inch thickness in the present example, and each lies approximately tangential to the platen 18 which is disposed on the opposite side of the paper 10 and provides a backing support for receiving the impact of the hammers 78 as seen in FIG. 4. Each hammer 78 includes a dot matrix printing tip 118 extending normal from the surface of the hammer element 110 adjacent the upper end 116 in the direction toward the ribbon 28 and paper 10. The tips 118 of the successive hammers 78 lie along a selected horizontal line substantially radial to the adjacent arc of the curved surface of the platen 18 and defining the printing line position. When retracted, each tip 118 is disposed slightly behind the front face 86 and adjacent an associated one of a plurality of apertures 120 in the front face 86. The tip 118 is integral or secured to a base disk 122 having an outwardly directed flange 124 relative to the tip, with the flange 124 being curved about the inner surface defining an aperture in the hammer element 110 so as to rivet the base disk 122 and coupled hammer tip 118 to the hammer element 110. Preferably, the tip 118 is mounted at that longitudinal position along the length of the hammer element 110 that defines the center of percussion of the hammer 78. When impacting, the tip 118 extends through the aperture 120 in the front face 86.

The hammer mechanism 70 operates by individually releasing the hammers 78 from a retracted position in which the hammers 78 are held against the coil wrapped pole pieces 80. A closed loop magnetic path is normally defined by a permanent magnet 104, the common return member 100, individual pole pieces 80, the hammer 78, and the insert 106. When retracted, the hammer is held with the tip 118 out of engagement with the ribbon 28 and slightly behind the side 86 of the cover 37 as previously described. The moving ink ribbon 28 therefore bears against the side 86 and does not slide with any substantial frictional force against the paper 10. When the coil 81 wrapped around a particular pole piece 80 is energized, however, the magnetic field in the individual circuit is neutralized adjacent the free end 116 of the hammer 78, and the hammer 78 is released. The spring effect of the hammer 78 causes it to fly with a predetermined velocity and flight time to impact the tip 118 against the ribbon 28 and underlying paper 10. The motion and force are both predictable and controllable, inasmuch as they result only from the constant spring characteristic of the element 110 comprising the hammer 78 and the distance of flight of the hammer. This high speed motion of the individual hammers 78 within the hammer mechanism is effectively employed with the continuous reciprocating motion as described in co-pending application Ser. No. 495,830.

The length of the magnetic circuit structure 76 is arbitrarily divided into a plurality of substantially uniform hammer positions 130. If a like hammer position 132 at each of the opposite ends of the magnetic circuit structure 72 is provided with one of the hammers 78, such end hammers have only one adjacent hammer whereas other hammers have an adjacent hammer on both sides thereof. It has been found that this asymmetry decreases the field strength of the permanent magnet as applied to the end hammers, resulting in a lower magnetic retract force for those hammers. In accordance with the invention each of the opposite end hammer positions 132 forms a dummy position through the omission of the coil 81 and pole piece 80 at this position and in most instances the hammer 78 itself. It has been found that the extension of the magnetic circuit structure 76 into the dummy position 132 results in the same field strength and thereby the same retract force in each end hammer as in any of the intervening hammers, thereby providing for uniform field strength throughout the hammer bank or mechanism 70.

Figure 5:
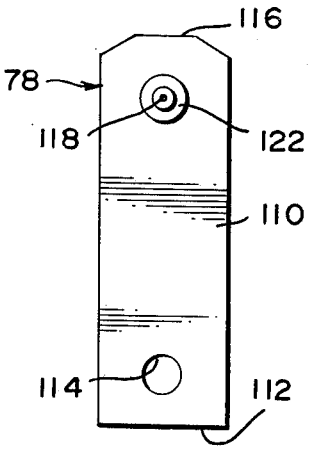
FIG. 5 is a plan view of a hammer element used in the hammer mechanism of FIG. 2.

The hammer spring or element 110 is shown in detail in FIG. 5. Such elements have critical physical characteristics such as flatness, dimensions, spring constant and magnetic properties, all of which affect the performance within the hammer mechanism. In accordance with the invention the hammer springs or elements 110 are fabricated and mounted individually rather than as part of an integral comb-like structure. It has been found that by fabricating and mounting the hammers individually, the hammers can be much more precisely fabricated as well as extensively tested for adherence to both physical properties and a final performance test, all of which add up to an assuring interchangeability and acceptable performance within the hammer mechanism. Also, yield of good individual springs or elements is more practical than attempting to fabricate a group of elements in one structure.

It has also been found that the printing tips 118 can be precisely aligned by mounting the hammers 78 individually. In one preferred mounting arrangement, the hammers 78 are mounted on the magnetic circuit structure 76 in pairs with each pair of hammers 78 using a common mounting plate 136 and a pair of screws 138. The mounting plate 136 is provided with a pair of holes 140 and 142 in the opposite ends thereof. One of the pair of screws 138 is inserted through the hole 140 and the hole 114 at the lower end 112 of the left hand hammer 78 and into a threaded hole 144 in the insert 106. The other screw 138 is inserted through the hole 142 in the mounting plate 136, the hole 114 at the bottom end 112 of the right hand hammer 78 and into a threaded hole 144 in the insert 106. The holes 114 at the bottom ends of the hammers 78 are made large enough to permit considerable play in the exact positioning of each hammer. The mounting plate 136 is restrained from turning when the screws 138 are tightened into the insert 106 since the plate is secured by a screw at each of the opposite ends thereof. This prevents the hammers 78 from turning relative to the magnetic circuit structure 76 as the screws 138 are tightened.

Figure 6:
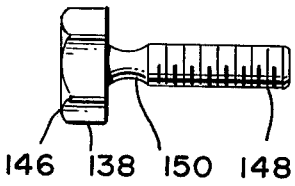
FIG. 6 is a side view of a screw used to mount hammer elements in the hammer mechanism of FIG. 2.
Figure 7:
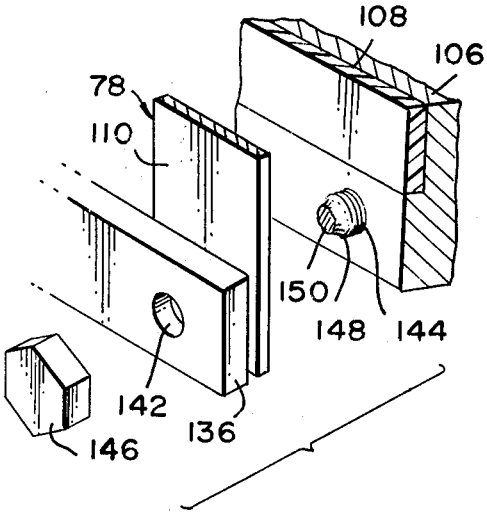
FIG. 7 is an exploded perspective view of a portion of the hammer mechanism of FIG. 2 illustrating the manner in which screws as shown in FIG. 6 break under excessive torque.

As shown in FIG. 6 each screw is comprised of a head 146 and a threaded shaft 148 extending from the head 146. The shaft 148 has a portion 150 of substantially reduced diameter adjacent the head 146. This causes the shaft 148 to break next to the head 146 rather than elsewhere along the length thereof when the screw 138 is subjected to excessive torque. Consequently the screws 138 can be torqued relatively tightly to provide a tight and secure fit for the hammers 78 without concern that a portion of the shaft 148 may break within the threaded hole 144 making removal of the broken portion extremely difficult or impossible and thereby making it impossible to install a hammer 78 at that particular hammer position. With the hammer mechanism absent just one hammer, such mechanism is rendered partly or totally useless for most applications. The result of one of the screws 138 breaking during mounting of a hammer 78 is shown in FIG. 7. Since the shaft 148 breaks immediately adjacent the head 146 a substantial portion of the broken shaft 148 is left protruding from the threaded hole 144 in the insert 104. This remaining portion of the shaft 148 is easily removed by hand or using an appropriate tool, following which a new screw 138 is installed to mount the hammer 78.

Individual mounting of the hammers 78 using the plate 136 and the screws 138 enables the precise clamping of the hammers which is necessary to accurately define the flex points of the hammers. Such mounting arrangement also enables the hammers to be mounted so that all hammer tips are precisely aligned and therefore capable of accurately printing dots. Also the hammers cannot become physically misaligned due to ribbon and paper jams that can occur in normal printer usage. Where desired a suitable fixture is provided to align the hammers 78 and their included printing tips 118 during mounting of the hammers. The predetermined breaking feature of the screws 138 combines with the mounting plate 136 to prevent the hammers 78 from being misaligned by normal ribbon or paper jams. In such situations the ribbon or paper tears first and the screws 138 fail immediately under the head if overstressed.

Figure 8:
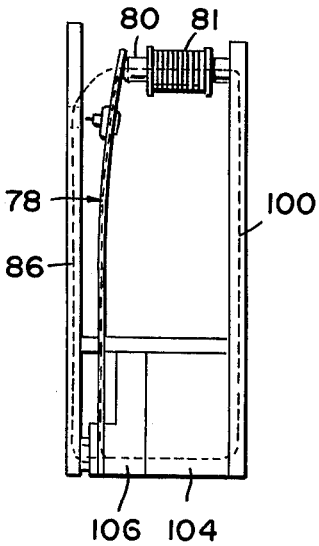
FIG. 8 is a side view of a portion of the hammer mechanism of FIG. 2 illustrating the double magnetic path provided by a portion of the cover.

As shown in FIG. 8 the front face 86 of the housing 37 is made of magnetic material and therefore enhances the magnetic circuit properties of the permanent magnetic hammer retract mechanism in addition to functioning to guide the ribbon in front of the retracted hammers and to prevent paper dust and other contaminants from entering the inside of the housing 37. The magnetic front face 86 forms a flux path in parallel with each hammer element 110. This increases the flux density in the region of contact of the hammer element 110 with the tip of the pole piece 80, resulting in a greater hammer retracting force than would otherwise be available with the hammer spring materials which are primarily selected for spring properties. Thus, if the hammer spring or element 110 is made larger in cross section to provide lower magnetic reluctance and therefore greater flux density, this advantage will be nullified by greater spring strength which makes retraction of the hammer more difficult. In addition the front face 86 of magnetic material is attracted to the permanent magnet 104 so as to hold the front face 86 in place against the hammer mechanism 70 for reciprocating movement therewith.

As previously noted air introduced under pressure into the interior of the housing 37 from the flexible hose 68 flows around the opposite ends of the planar common return member 100 and through the holes 102 therein to cool the hammer mechanism and particularly the coils 81 surrounding the pole pieces 80. This cooling action becomes important to avoid excessive heating under continuous printer operation. In addition the pressurized air which has been filtered before it enters the hammer mechanism is effective in keeping out dirt from the paper, the ribbon and the like. In addition the air provides reduction in the noise generated by the hammers during operation of the printer. The air which flows up along the hammers 78 and the coils 81 exits through the opening 96 at the top of the cover 74. Although not shown in FIG. 2 the front face 86 may be made slightly longer than the rest of the housing 37 to maintain the housing 37 in a closed condition for different longitudinal positions of the front face 86, thereby preventing the pressurized air from escaping before it has a chance to cool the hammer mechanism.

When there is no air flow through the housing 37 such as when the printer is turned off, it is possible that paper dust or other contaminants could enter the housing 37 through the opening 96. To prevent this the filter 98 is located within the opening 96. The filter 98 which is made of open cell foam or other appropriate material allows the flowing air within the housing 37 to exit freely while at the same time inhibiting dust and other contaminants from entering. The same or similar material as that used for the filter 98 is used to make seals 160 and 162 shown in FIG. 4. The seal 160 is disposed on top of the insert 106 and the permanent magnet 104 so as to extend between the hammers 78 and the planar common return member 100. The seal 162 extends between the hammers 78 and the inside surface of the side 86 of the housing 37. The seals 160 and 162 prevent any dust that might enter the cover 74 from falling between the hammers 78 and the surrounding structure including, in particular, the resilient damping element 108.

While the invention has been particularly shown and described with reference to a preferred embodiment thereof, it will be understood by those skilled in the art that various changes in form and details may be made therein without departing from the spirit and scope of the invention.

What is claimed is:

1. A hammer mechanism for a printer comprising:

a housing having a hollow interior and a magnetic portion thereof;

means for introducing air under pressure into the interior of the housing;

an elongated magnetic circuit structure including permanent magnet means extending along the length of the magnetic circuit structure, the length of the magnetic circuit structure being divided into a succession of like hammer element positions, there being a dummy hammer element position adjacent each end of the magnetic circuit structure and a plurality of intermediate hammer element positions therebetween;

a different resilient magnetic hammer element coupled to the magnetic circuit structure in each of the intermediate hammer element positions and only in the intermediate hammer element positions, each hammer element being disposed adjacent the magnetic portion of the housing and separated from the other hammer elements;

a plurality of electrical coils, each being mounted on the magnetic circuit structure in a different one of the hammer element positions and extending into the region of a different one of the hammer elements; and means for selectively energizing the electrical coils to momentarily release the associated hammer elements from the electrical coils.

2. The invention defined in claim 1, wherein the hammer elements are mounted on the magnetic circuit structure in pairs with each pair being mounted by a different plate having holes in the opposite ends thereof and a pair of screws, each of the screws extends through a different one of the holes in the plate, a hole in a hammer element and into the magnetic circuit structure, each of the screws has a portion of reduced diameter immediately under a head thereof, the housing has an opening therein, and further including filter means disposed in the opening, the filter means passing air therethrough while blocking solid contaminants.

3. A hammer mechanism for a printer comprising:

an elongated magnetic circuit structure including permanent magnet means extending along the length of the magnetic circuit structure, the length of the magnetic circuit structure being divided into a succession of hammer element positions of generally uniform size, there being a dummy hammer element position adjacent each end of the magnetic circuit structure and a plurality of intermediate hammer element positions therebetween;

a different resilient magnetic hammer element coupled to the magnetic circuit structure in each of the intermediate hammer element positions and only in the intermediate hammer element positions, the permanent magnet means establishing a magnetic field normally maintaining each hammer element in a spring-loaded retracted position; and different means associated with each of the magnetic hammer elements and coupled to the magnetic circuit structure for substantially cancelling the magnetic field in a portion of the magnetic circuit structure adjacent the associated hammer element to release the associated hammer element from the retracted position for a selected period of time.

4. The invention defined in claim 3, wherein the magnetic circuit structure comprises an elongated, generally planar, magnetic common return member extending along the length of the magnetic circuit structure and having a generally uniform width between opposite edges in directions generally normal to the direction of elongation thereof, an elongated permanent magnet extending along the length of the magnetic circuit structure and coupled to the common return member adjacent one of the opposite edges of the common return member, and a plurality of pole pieces coupled to the common return member adjacent the other one of the opposite edges of the common return member and spaced-apart along the length of the common return member, wherein each of the hammer elements is of generally elongated configuration between opposite ends and has one end thereof coupled to the permanent magnet and the opposite end thereof disposed adjacent a different one of the pole pieces, and wherein each means for substantially cancelling comprises a coil coupled to a different one of the pole pieces.

5. A hammer mechanism for a printer comprising:

a magnetic circuit structure including permanent magnet means;

a plurality of resilient magnetic hammer elements coupled to the magnetic circuit structure, the permanent magnet means establishing a magnetic field normally maintaining each hammer element in a spring-loaded retracted position;

different means associated with each of the magnetic hammer elements and coupled to the magnetic circuit structure for substantially cancelling the magnetic field in a portion of the magnetic circuit structure adjacent the associated hammer element to release the associated hammer element from the retracted position for a selected period of time; and a relatively thin, generally planar barrier element of magnetic material mounted on the magnetic circuit structure and disposed adjacent and spaced-apart from the magnetic hammer elements and the different means for substantially cancelling the barrier element providing a magnetic path in parallel with a magnetic path defined by each magnetic hammer element, the barrier element comprising part of a housing enclosing the hammer mechanism;

each of the hammer elements having a printing tip mounted thereon and a barrier element being generally parallel to the hammer elements and having a plurality of holes therein through which the printing tips extend to the outside of the housing when the hammer elements mounting the printing tips are released from the retracted position for the selected period of time.

6. A hammer mechanism for a printer comprising:

a magnetic circuit structure including permanent magnet means;

a plurality of resilient magnetic hammer elements coupled to the magnetic circuit structure, the permanent magnet means establishing a magnetic field normally maintaining each hammer element in a spring-loaded retracted position;

different means associated with each of the magentic hammer elements and coupled to the magnetic circuit structure for substantially cancelling the magnetic field in a portion of the magnetic circuit structure adjacent the associated hammer element to release the associated hammer element from the retracted position for a selected period of time; and a relatively thin, generally planar barrier element of magnetic material mounted on the magnetic circuit structure and disposed adjacent and spaced-apart from the magnetic hammer elements and the different means for substantially cancelling the barrier element providing a magnetic path in parallel with a magnetic path defined by each magnetic hammer element, the barrier element comprising part of a housing enclosing the hammer mechanism;

the means for substantially cancelling the magnetic field comprising a plurality of electrical coils and means for selectively energizing the electrical coils, and further including means for introducing air under pressure into the inside of the housing to cool the hammer mechanism including the electrical coils.

7. The invention defined in claim 6, wherein the housing has an opening therein, and further including filter means disposed within said opening, said filter means permitting the exit of the air therethrough from the inside of the housing while preventing contaminants outside the housing from entering the housing through the filter.

8. A hammer mechanism for a printer comprising:

a housing having a hollow interior and a plurality of openings therein;

a magnetic circuit structure mounted within the interior of the housing;

electrical coil means mounted on and forming a part of the magnetic circuit structure;

a plurality of hammer elements having one portion thereof coupled to the magnetic circuit structure at a location thereon away from the electrical coil means and normally maintained in and temporarily releasable from a spring-loaded retracted position in which a portion thereof opposite said one portion is held against the electrical coil means by a magnetic force, each of the hammer elements including print means which extends through a different one of the plurality of openings in the housing to the outside of the housing when the hammer element is temporarily released from the retracted position;

means for selectively energizing the electrical coil means to overcome said magnetic force and temporarily release the hammer elements from the retracted position; and means for introducing air under pressure into the interior of the housing to cool the hammer mechanism including the electrical coil means.

9. The invention defined in claim 8, wherein the means for introducing air includes a source of pressurized air and a flexible hose coupling the source of pressurized air to the interior of the housing.

10. The invention defined in claim 8, wherein the housing has an opening therein for permitting air to exit from the interior thereof, and further including filter means disposed in the opening for permitting air exiting from the interior of the housing to pass therethrough while preventing contaminants outside of the housing from reaching the interior of the cover.

11. The invention defined in claim 8, wherein the housing includes top, bottom and opposite side members extending between opposite end members and has a space between the top member and one of the side members, the magnetic circuit structure extends from the bottom member to the region of the top member between the opposite side members and is spaced-apart from the opposite ends, the electrical coil means are disposed between the magnetic circuit structure and said one side member, and the air is introduced under pressure into the interior of the housing at the other one of the side members.

12. The invention defined in claim 11, further including filter means disposed in the space between the top member and one of the side members of the housing, the filter means freely passing air to the exclusion of solid contaminants.

13. The invention defined in claim 12, further including second filter means disposed between the hammer elements and said one side member of the housing and third filter means disposed between the hammer elements and the magnetic circuit structure.

14. A hammer mechanism for a printer comprising:

a magnetic circuit structure having a hammer element mounted portion and an opposite hammer element holding portion;

a plurality of resilient magnetic hammer elements, each having a first end mounted on the mounting portion of the magnetic circuit structure and an opposite second end normally in contact with the holding portion of the magnetic circuit structure when the hammer element is in a retracted position to complete a magnetic circuit through the magnetic circuit structure;

permanent magnet means forming a part of the magnetic circuit structure and operative to provide magnetic flux in the magnetic circuit structure to normally hold the hammer elements in the retracted position;

a plurality of flux cancelling means forming a part of the magnetic circuit structure and each being associated with a different one of the hammer elements and operative when energized to generate a magnetic flux in the region of the associated hammer element which overcomes the magnetic flux from the permanent magnet means and momentarily releases the associated hammer element from the retracted position; and a housing having the magnetic circuit structure and the included hammer elements, permanent magnet means and flux cancelling means mounted therein, said housing having a portion of magnetic material coupled to the magnetic circuit structure adjacent the hammer element mounting portion and extending generally parallel to and spaced-apart from the hammer elements to a region adjacent the holding portion of the magnetic circuit structure to form auxiliary flux paths parallel with the hammer elements and thereby increase the flux density in the region of the holding portion of the magnetic circuit structure, said portion of magnetic material having at least one aperture therein to provide access to the outside of the housing for the hammer elements.

15. The invention defined in claim 14, wherein the portion of magnetic material of the housing has a plurality of apertures therein, and further including a plurality of impact printing elements, each mounted on a different hammer element adjacent the second end thereof and extending at least partially into one of the apertures in the portion of magnetic material of the housing.

16. A hammer mechanism for a printer comprising:

a magnetic circuit structure having a generally U-shaped cross-section defined by a pair of opposite end portions extending from an intermediate portion, one of the opposite end portions defining a hammer element mounting region and the other one of the opposite end portions defining a hammer element holding region;

a permanent magnet included in and forming a part of the magnetic circuit structure;

a plurality of coils mounted on the other one of the opposite end portions and spaced apart along the length of the magnetic circuit structure;

a plurality of elongated hammer elements mounted in spaced-apart relation at first ends thereof along the length of the magnetic circuit structure at the mounting region and having opposite second ends thereof disposed adjacent different respective ones of the coils, each of the hammer elements being held in a retracted position against the holding region by the permanent magnet except when an adjacent one of the coils is energized; and a generally rectangular housing having a bottom on which said one of the opposite end portions of the magnetic circuit structure is mounted, a top adjacent said other one of the opposite end portions of the magnetic circuit structure, a first side adjacent the intermediate portion of the magnetic circuit structure, and a second side adjacent the hammer elements, the second side being made of magnetic material and contacting the mounting region of the magnetic circuit structure and extending along the length of the hammer elements in generally parallel, spaced-apart relation thereto past the holding region of the magnetic circuit structure to form a plurality of magnetic paths parallel to the hammer elements as well as a portion of the housing enclosing the magnetic circuit structure, the permanent magnet, the coils and the hammer elements, the second side having at last one hole therein to provide access to the outside of the housing for the hammer elements.

17. The invention defined in claim 16, wherein said other end portion of the magnetic circuit structure comprises a plurality of pole pieces mounted in spaced-apart relation along the length of the intermediate portion and having outer ends opposite the intermediate portion of the magnetic circuit structure which define the holding region, the first ends of the hammer elements are mounted on the first end portion of the magnetic circuit structure by arrangements including bolts which extend through the hammer elements and into said one end portion of the magnetic circuit structure, and the second side of the housing is held against the bolts by magnetic force from the permanent magnet.

18. The invention defined in claim 17, further including a plurality of impact printing elements, each mounted on the second end of a different one of the hammer elements, and wherein the second side of the housing has a plurality of holes therein, each positioned to receive a different one of the impact printing elements.

* * * * *

UNITED STATES PATENT OFFICE

CERTIFICATE OF CORRECTION

Patent No. 4,044,668 Dated August 30, 1977

Inventor(s) Gordon Brent Barrus et al.

It is certified that error appears in the above-identified patent and that said Letters Patent are hereby corrected as shown below:

Column 2, line 47, "to" should read -- with --.

Column 10, line 64, after "and" and before "barrier", "a" should read -- the --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*